US011640784B2

(12) United States Patent
Su et al.

(10) Patent No.: US 11,640,784 B2
(45) Date of Patent: May 2, 2023

(54) MICRO LIGHT EMITTING DIODE DISPLAY AND CONTROLLER THEREOF

(71) Applicant: PlayNitride Display Co., Ltd., MiaoLi County (TW)

(72) Inventors: Po-Jen Su, MiaoLi County (TW); Kun-Hua Tsai, MiaoLi County (TW)

(73) Assignee: PlayNitride Display Co., Ltd., MiaoLi County (TW)

( * ) Notice: Subject to any disclaimer, the term of this patent is extended or adjusted under 35 U.S.C. 154(b) by 47 days.

(21) Appl. No.: 17/322,940

(22) Filed: May 18, 2021

(65) Prior Publication Data

US 2022/0059015 A1 Feb. 24, 2022

Related U.S. Application Data

(60) Provisional application No. 63/069,693, filed on Aug. 24, 2020.

(30) Foreign Application Priority Data

Mar. 30, 2021 (TW) ..... 110111460

(51) Int. Cl.
*G09G 3/32* (2016.01)

(52) U.S. Cl.
CPC ..... *G09G 3/32* (2013.01); *G09G 2310/0275* (2013.01); *G09G 2320/0242* (2013.01);
(Continued)

(58) Field of Classification Search
CPC ..... G09G 3/32; G09G 2310/0275; G09G 2320/0242; G09G 2320/0247;
(Continued)

(56) References Cited

U.S. PATENT DOCUMENTS

2003/0168969 A1 9/2003 Tanabe
2005/0116616 A1 6/2005 Koeda
(Continued)

FOREIGN PATENT DOCUMENTS

CN 1892364 1/2007
CN 101295486 10/2008
(Continued)

OTHER PUBLICATIONS

Ruan Hai-Rong et al., "Brightness Correction Method of LED Display Based on Photographing", Chinese Journal of Liquid Crystals and Displays, vol. 27, No. 2, with English abstract, Oct. 31, 2012, pp. 1-5.
(Continued)

*Primary Examiner* — Andrew Sasinowski
(74) *Attorney, Agent, or Firm* — JCIPRNET

(57) ABSTRACT

A micro light emitting diode (micro LED) display and a controller thereof are provided. The micro LED display includes a circuit board, a plurality of micro LED devices, and the controller. The micro LED devices are disposed on a first surface of the circuit board. The micro LED devices respectively have a plurality of pixel arrays. The controller is carried by the circuit board and is configured to transmit a plurality of control signals to respectively control display statuses of the pixel arrays of the micro LED devices.

24 Claims, 21 Drawing Sheets

(52) U.S. Cl.
CPC ..... *G09G 2320/0247* (2013.01); *G09G 2320/041* (2013.01)

(58) Field of Classification Search
CPC ..... G09G 2320/041; G09G 2300/0452; G09G 2320/0673; G09G 2330/12; G09G 3/2096; G09G 2310/0297; G09G 2330/021
See application file for complete search history.

(56) References Cited

U.S. PATENT DOCUMENTS

| | | | | |
|---|---|---|---|---|
| 2009/0009455 | A1 | 1/2009 | Kimura | |
| 2012/0194565 | A1 | 8/2012 | White et al. | |
| 2013/0127923 | A1 | 5/2013 | An et al. | |
| 2016/0267834 | A1* | 9/2016 | Zheng | G09G 3/32 |
| 2017/0133818 | A1 | 5/2017 | Cok | |
| 2018/0102085 | A1 | 4/2018 | Pan | |
| 2018/0182288 | A1 | 6/2018 | Kim et al. | |
| 2018/0323180 | A1* | 11/2018 | Cok | H01L 23/5386 |
| 2019/0027534 | A1* | 1/2019 | Rotzoll | H01L 27/156 |
| 2019/0266976 | A1* | 8/2019 | Wyble | G06F 3/147 |
| 2019/0318696 | A1* | 10/2019 | Imai | G09G 3/3607 |
| 2020/0020676 | A1 | 1/2020 | Cok et al. | |
| 2020/0193899 | A1 | 6/2020 | Li et al. | |
| 2020/0312216 | A1* | 10/2020 | Kim | G09G 3/2081 |

FOREIGN PATENT DOCUMENTS

| | | |
|---|---|---|
| CN | 102473372 | 5/2012 |
| CN | 103730090 | 4/2014 |
| CN | 103730483 | 4/2014 |
| CN | 103745683 | 4/2014 |
| CN | 104021773 | 9/2014 |
| CN | 107293255 | 10/2017 |
| CN | 206977607 | 2/2018 |
| CN | 109216525 | 1/2019 |
| CN | 110033709 | 7/2019 |
| CN | 110783324 | 2/2020 |
| CN | 111028697 | 4/2020 |
| JP | 2003115613 | 4/2003 |
| JP | 2006091850 | 4/2006 |
| JP | 2018010060 | 1/2018 |
| KR | 20200009402 | 1/2020 |
| TW | 201911562 | 3/2019 |
| WO | 2017043216 | 3/2017 |

OTHER PUBLICATIONS

"Office Action of China Counterpart Application", dated Jun. 16, 2022, p. 1-p. 16.
"Office Action of Taiwan Counterpart Application", dated Jan. 20, 2022, p. 1-p. 5.
"Office Action of China Counterpart Application", dated Dec. 30, 2022, p. 1-p. 6.

* cited by examiner

MICRO LIGHT EMITTING DIODE DISPLAY AND CONTROLLER THEREOF

CROSS-REFERENCE TO RELATED APPLICATION

This application claims the priority benefit of U.S. provisional application Ser. No. 63/069,693, filed on Aug. 24, 2020 and Taiwan application serial no. 110111460, filed on Mar. 30, 2021. The entirety of each of the above-mentioned patent applications is hereby incorporated by reference herein and made a part of this specification.

BACKGROUND

Technical Field

The disclosure relates to a micro light emitting diode (micro LED) display and a controller thereof, and particularly relates to a micro LED display and a controller thereof which can improve the resolution and display quality.

Description of Related Art

With the advancement of electronic technology, it has become a trend to provide high-quality display interfaces in electronic products. After the successful development of miniaturization techniques of LEDs, displays designed with micro LEDs have become mainstream. In the related art, generally, a plurality of micro LED devices are provided in a micro LED display, and a plurality of controllers are provided in correspondence with the micro LED devices, so that the controllers can respectively perform one-to-one control operations in correspondence with the micro LED devices.

However, such a configuration requires a certain spacing between the micro LED devices in the layout. As a result, the resolution of the micro LED display is limited and cannot be effectively improved.

SUMMARY

The disclosure provides a micro LED display and a controller thereof which can increase the layout density and improve the display quality.

A micro LED display according to an embodiment of the disclosure includes a first circuit board, a plurality of first micro LED devices, and a first controller. The first micro LED devices are disposed on a first surface of the first circuit board, and the first micro LED devices respectively have a plurality of first pixel arrays. The first controller is carried by the first circuit board and is configured to transmit a plurality of first control signals to respectively control display statuses of the first pixel arrays of the first micro LED devices.

A controller according to an embodiment of the disclosure is configured to drive a micro LED display. The controller includes an interface circuit, a data driving circuit, and a core circuit. The interface circuit receives a command/data signal according to a clock signal based on a mode setting signal to obtain a command data and a display data. The data driving circuit is configured to generate a plurality of control signals to respectively control display statuses of a plurality of pixel arrays. The core circuit is coupled to the interface circuit and the data driving circuit. The core circuit is configured to perform a pixel arrangement calculation on the display data according to an arrangement of a plurality of micro LEDs of each of the pixel arrays to generate a compensated display data. The data driving circuit generates the control signals according to the compensated display data to respectively drive a plurality of micro LED devices.

Based on the above, the micro LED display of the disclosure controls the display statuses of a plurality of micro LED devices through the first controller. Accordingly, the layout pitch between the micro LED devices can be reduced, which can improve the resolution of the micro LED display. In addition, the first controller of the embodiment of the disclosure performs a pixel arrangement calculation on the display data according to the arrangement of the micro LEDs in each pixel array to further improve the display quality.

DESCRIPTION OF THE EMBODIMENTS

Figure 1:
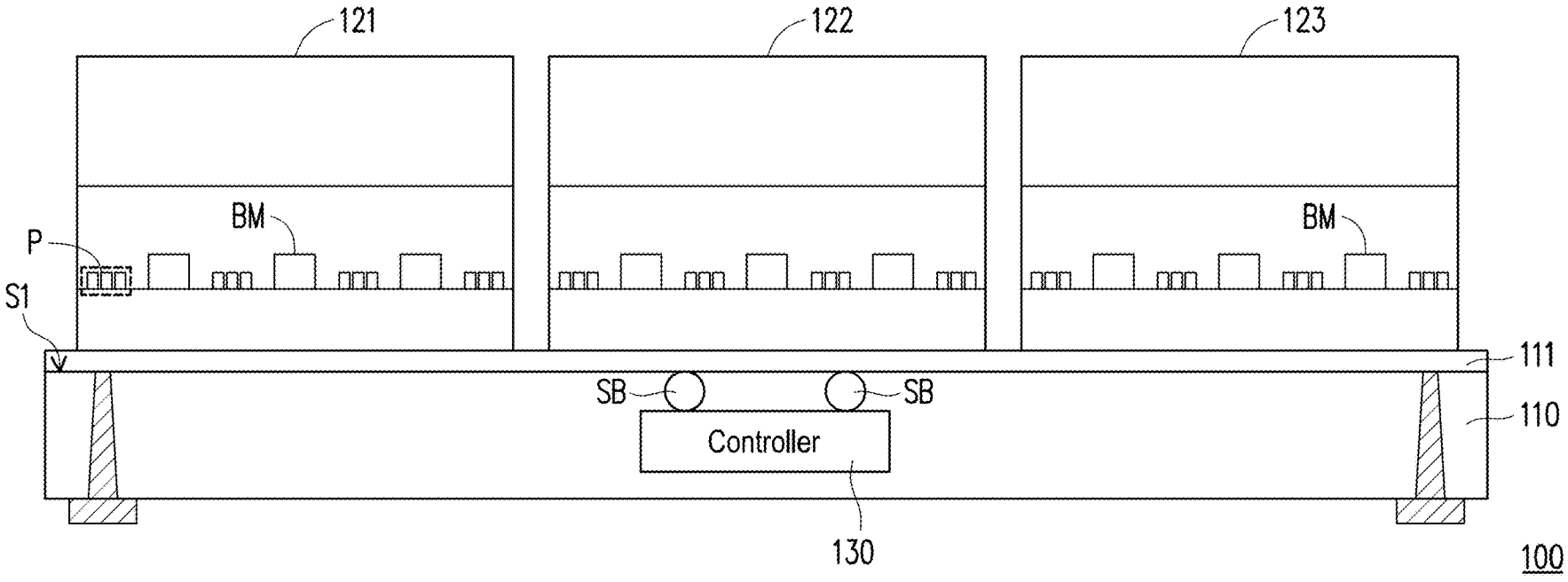
FIG. 1 is a schematic view showing a micro light emitting diode (micro LED) display according to an embodiment of the disclosure.

Referring to FIG. 1, FIG. 1 is a schematic view showing a micro light emitting diode (micro LED) display according to an embodiment of the disclosure. A micro LED display 100 includes a circuit board 110, micro LED devices 121 to 123, and a controller 130. The circuit board 110 may be a printed circuit board (PCB) or another substrate with driving circuits. The micro LED device 121 to 123 may be disposed on a first surface S1 of the circuit board 110, and the micro LED devices 121 to 123 respectively have pixel arrays composed of micro LEDs. The micro LED devices 121 to 123 are electrically connected to a transmission line layer 111 formed of a plurality of transmission lines on the circuit board 110. The transmission line layer 111 is formed on the first surface S1 of the circuit board 110 and is located between the first surface S1 of the circuit board 110 and the micro LED devices 121 to 123.

The controller 130 may be carried on the circuit board 110 and may be electrically connected to the transmission line layer 111 via conductive bumps SB. The controller 130 is configured to transmit a plurality of control signals to respectively control the display status of each pixel P in the pixel arrays of the micro LED devices 121 to 123. A light absorption layer BM is provided between adjacent pixels P. In this embodiment, one controller 130 may control three or more micro LED devices, which can effectively improve the fineness of the display image generated by the micro LED display.

In this embodiment, the display status of each pixel P in the micro LED devices 121 to 123 may be collectively controlled by the controller 130. Therefore, compared to the related art in which each micro LED device needs to be correspondingly provided with a controller, the pitch between the micro LED devices 121 to 123 on the circuit board 110 can be effectively reduced, so that the number of micro LED devices on a fixed-size display panel can be increased, and the display resolution can be improved.

In this embodiment, the pixel array of each of the micro LED devices 121 to 123 may have n times m pixels P, where n and m are integers greater than or equal to 4, and the pitch of the pixels P may be less than or equal to 0.6 mm, which can achieve a better display effect. If n and m are less than 4, the display fineness of each micro LED device would be insufficient. Each pixel P may be composed of a plurality of micro LEDs, and the length and width dimensions of the micro LED may be less than or equal to 50 micrometers. With the pitch of the pixels P being less than or equal to 0.5 mm, the display fineness can be further improved. In addition, in the embodiment of the disclosure, the number of the micro LED devices 121 to 123 is not particularly limited, and the three micro LED devices 121 to 123 shown in FIG. 1 are only an example for illustration and are not intended to limit the scope of implementation of the disclosure.

Figure 2A:
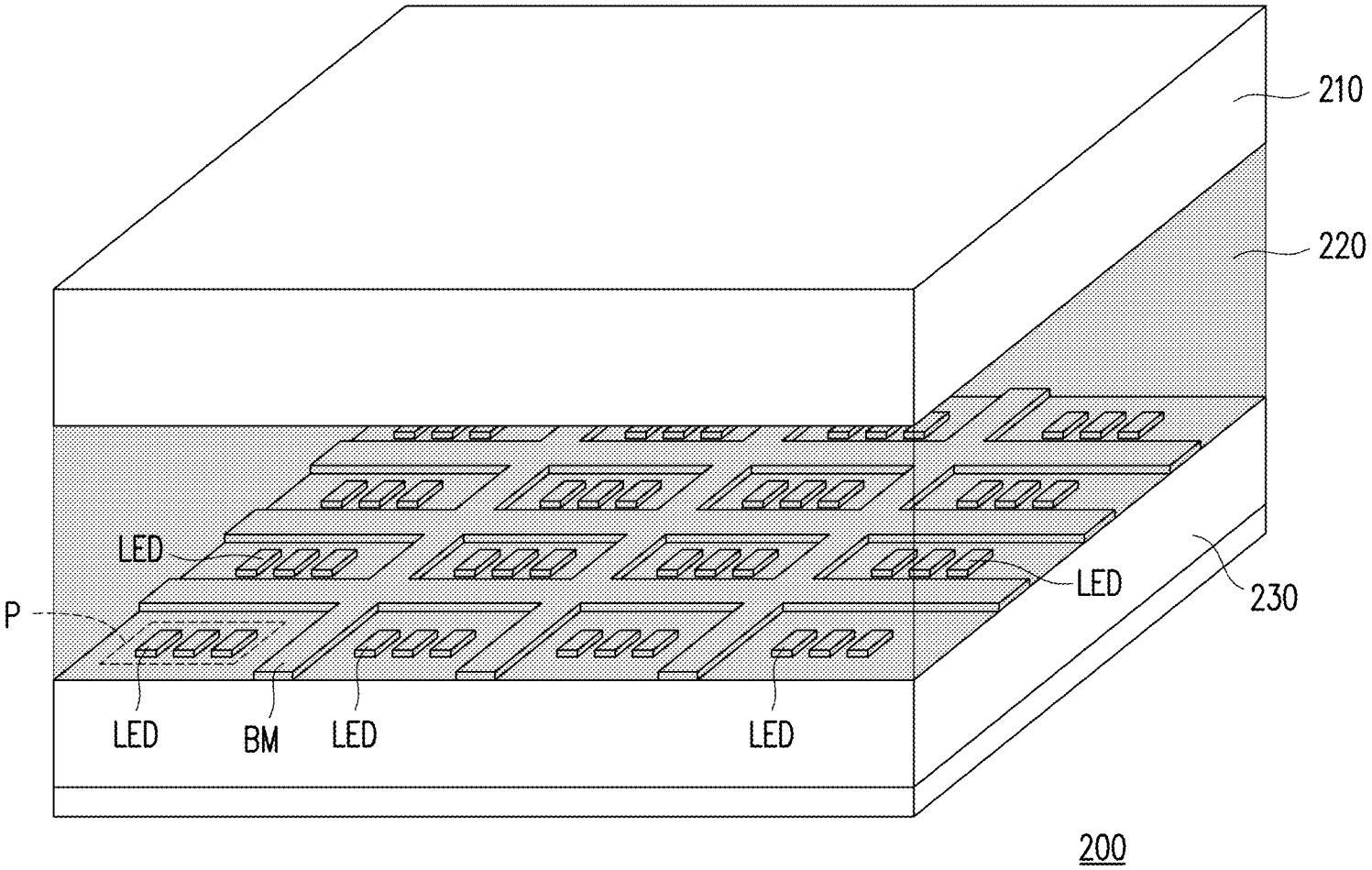
FIG. 2A is a schematic structural view showing micro LED devices in a micro LED display according to an embodiment of the disclosure.
Figure 2B:
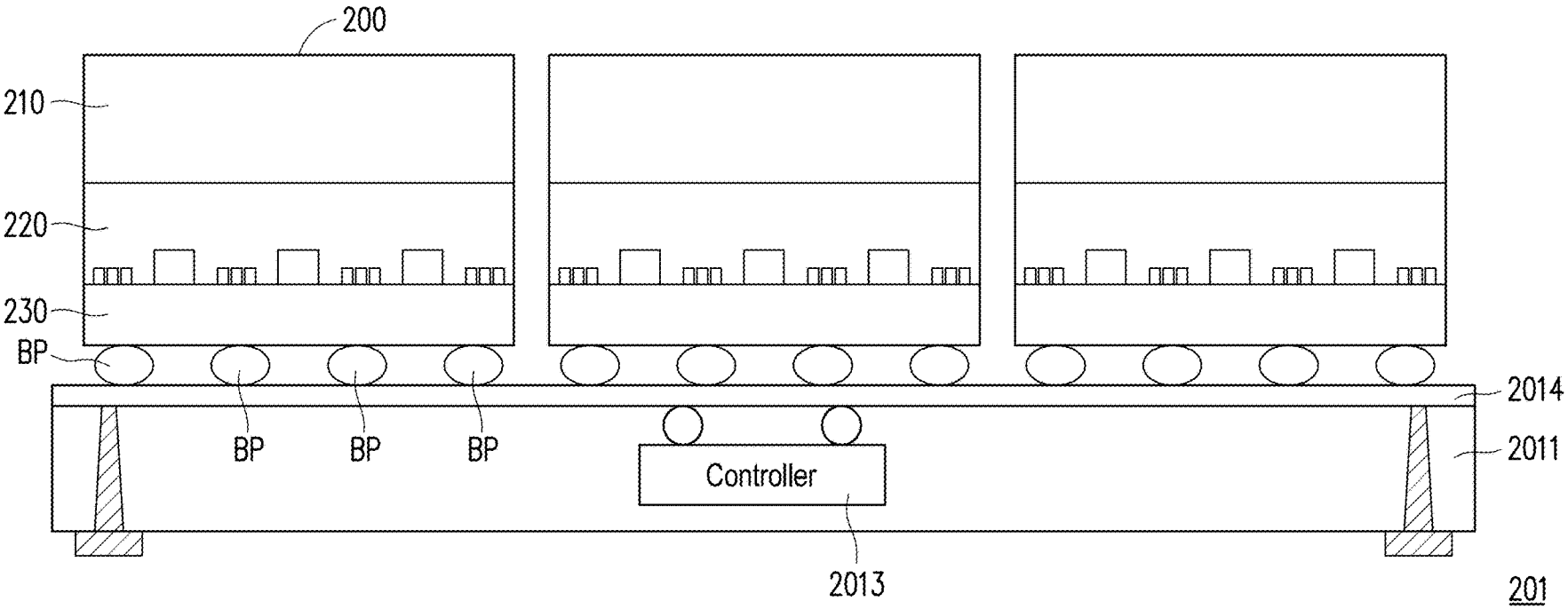
FIG. 2B is a schematic view showing a micro LED display according to another embodiment of the disclosure.

Next, referring to FIG. 2A and FIG. 2B, FIG. 2A is a schematic structural view showing micro LED devices in a micro LED display according to an embodiment of the disclosure, and FIG. 2B is a schematic view showing a micro LED display according to another embodiment of the disclosure. A micro LED device 200 includes a light mixing layer 210, an optical adhesive layer 220, a light absorption layer BM, and a wiring layer 230. The light mixing layer 210 is disposed on the optical adhesive layer 220, and the wiring layer 230 is provided under the optical adhesive layer 220. A pixel array formed of micro LEDs (labeled as LED) is disposed on the wiring layer 230 and is located in the optical adhesive layer 220, and each pixel P includes at least three micro LEDs (labeled as LED) of different light colors. The light absorption layer BM may be a black matrix formed by a black photoresist and may absorb light and block light to prevent the pixels P from interfering with each other.

In FIG. 2B, a micro LED display 201 includes a plurality of micro LED devices 200 as shown in FIG. 2A, a circuit board 2011, and a controller 2013. The micro LED devices 200 are disposed on the circuit board 2011. The wiring layer 230 of the micro LED device 200 is electrically connected to a transmission line layer 2014 on the circuit board 2011. By rewiring with the wiring layer 230, the transmission line layer 2014 required on the circuit board 2011 can be simplified, which makes the display lighter and thinner. In this embodiment, the wiring layer 230 of the micro LED device 200 may be electrically connected to the transmission line layer 2014 via conductive bumps BP (e.g., solder balls).

In this embodiment, the controller 2013 may be embedded in the circuit board 2011 and electrically coupled to the wiring layer 230 via a plurality of vias. In other embodiments of the disclosure, the controller 2013 may also be disposed on a first surface (upper surface) or a second surface (lower surface) of the circuit board 2011. The micro LED devices 200 are disposed on the first surface (upper surface) of the circuit board 2011.

Figure 3A:
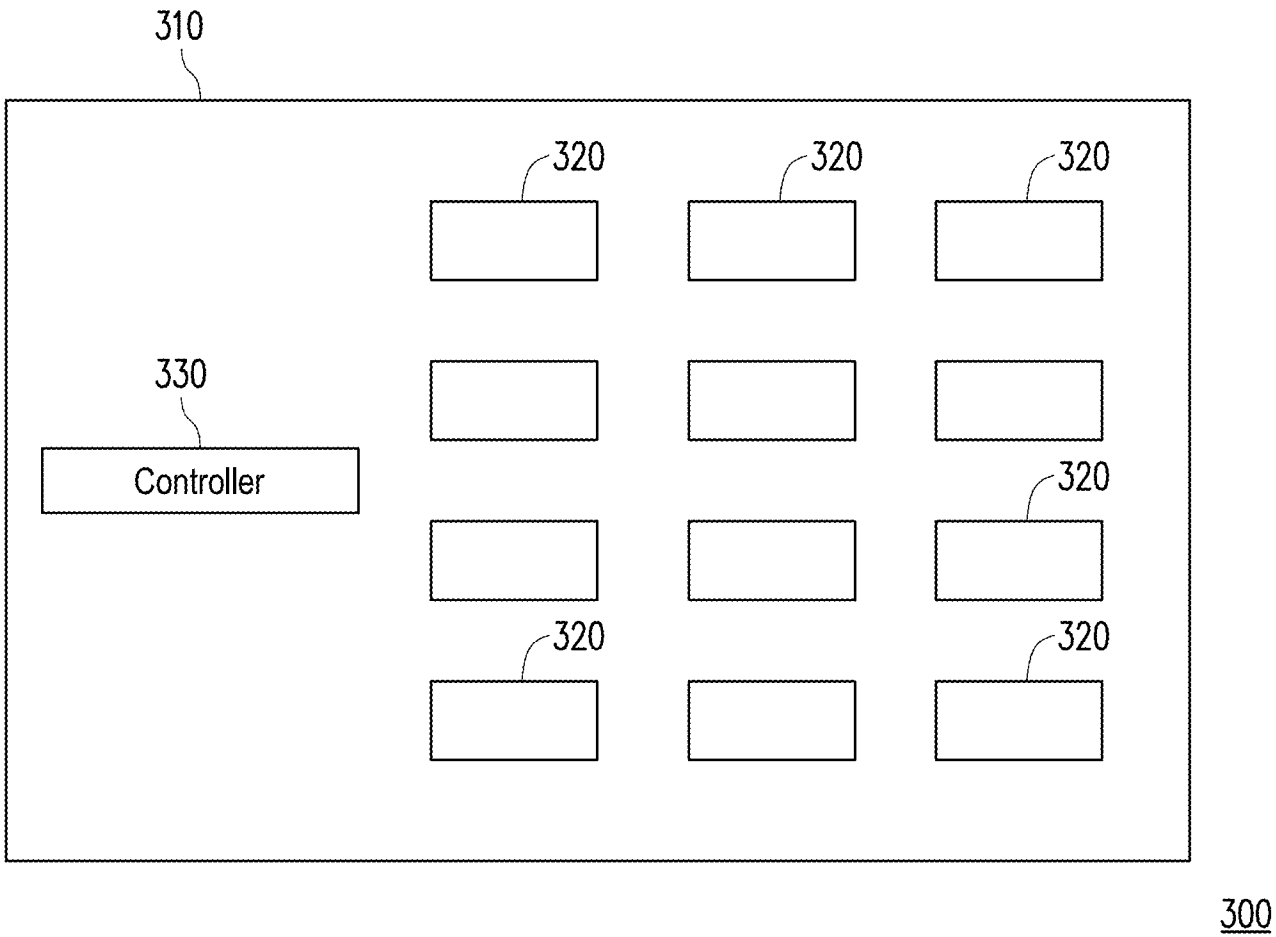
FIG. 3A and FIG. 3B are top views showing micro LED displays according to embodiments of the disclosure.

Referring to FIG. 3A to FIG. 3F, FIG. 3A and FIG. 3B are top views showing micro LED displays according to embodiments of the disclosure, and FIG. 3C to FIG. 3F are cross-sectional views showing micro LED displays according to different embodiments of the disclosure. In FIG. 3A, a micro LED display 300 includes a circuit board 310, a plurality of micro LED devices 320, and a controller 330. The controller 330 is disposed on one side of the circuit board 310, and the micro LED devices 320 are disposed on another side of the circuit board 310. It is noted that orthographic projections of the micro LED devices 320 on the circuit board 310 do not overlap with an orthographic projection of the controller 330 on the circuit board 310. Such a configuration can prevent deterioration of the performance of the controller 330 resulting from influence by the light emitted by the micro LED devices 320.

Figure 3B:
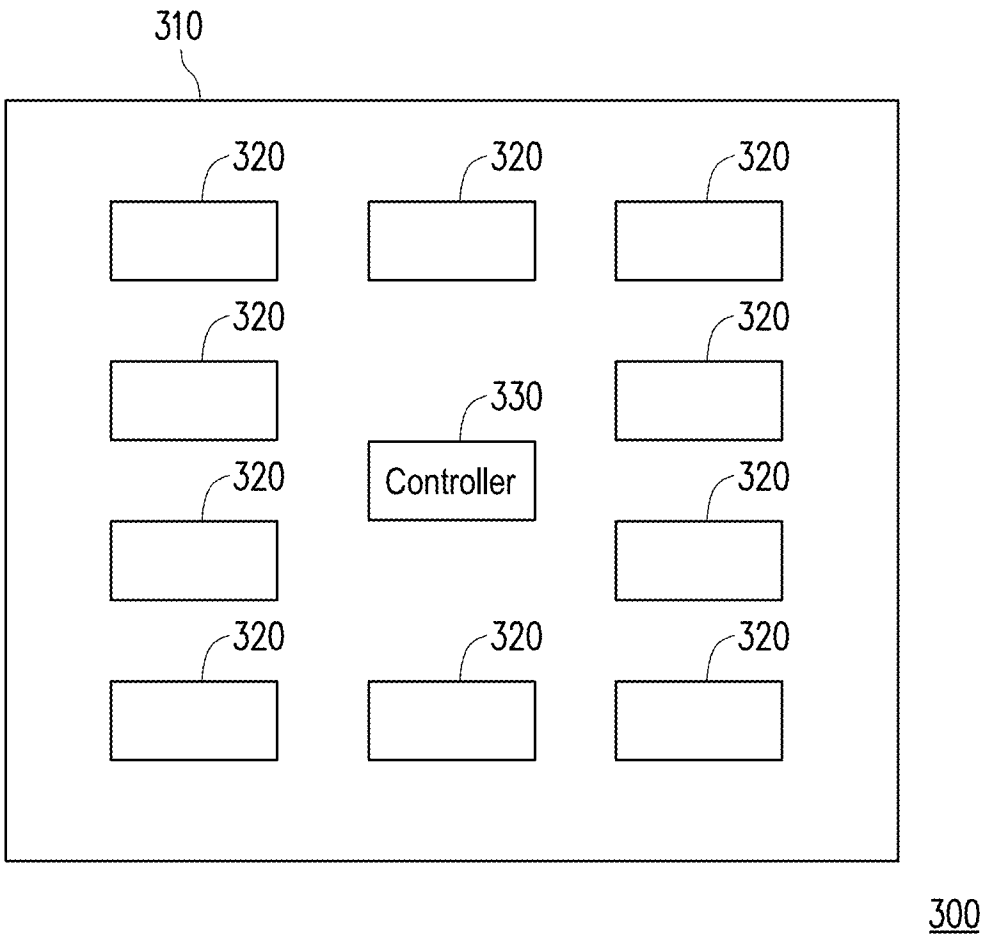

In FIG. 3B, in the micro LED display 300 of the embodiment of the disclosure, the micro LED devices 320 may be disposed around the controller 330. Through such a design, the wiring length and complexity between the controller 330 and the micro LED devices 320 can be reduced.

Figure 3C:
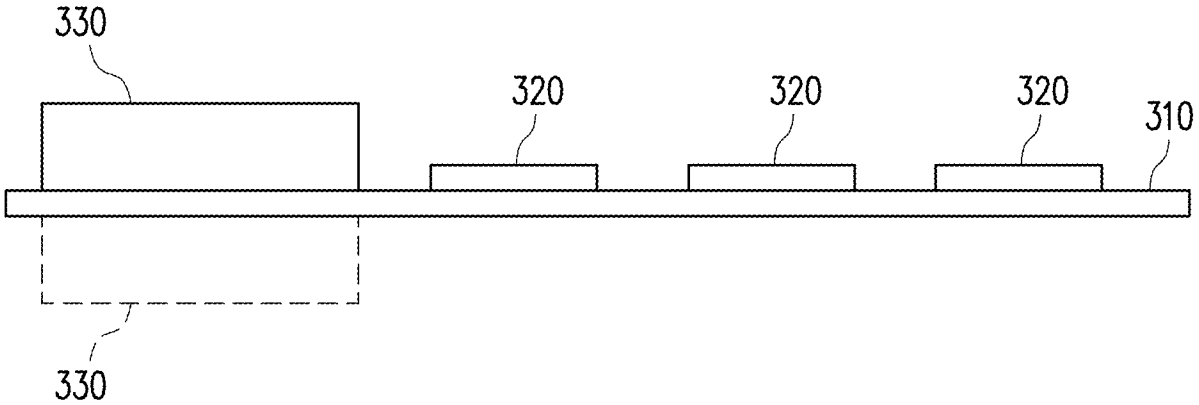
FIG. 3C to FIG. 3F are cross-sectional views showing micro LED displays according to embodiments of the disclosure.

In addition, in FIG. 3C, in the micro LED display 300 of the embodiment of the disclosure, the controller 330 and the micro LED devices 320 may be disposed on the same surface of the circuit board 310. Alternatively, the controller 330 and the micro LED devices 320 may also be disposed on different surfaces of the circuit board 310, which is not particularly limited herein.

Figure 3D:
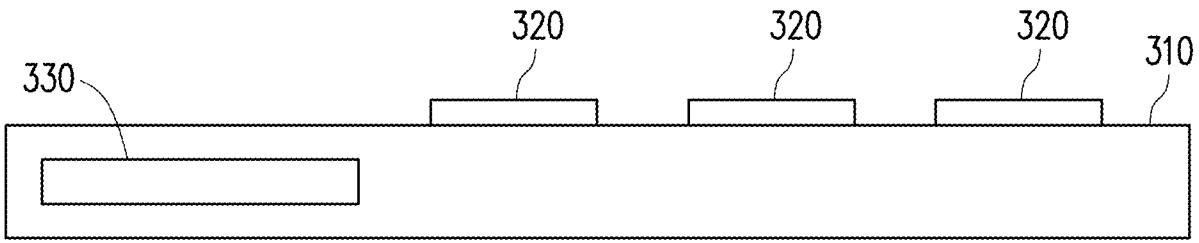
Figure 3E:
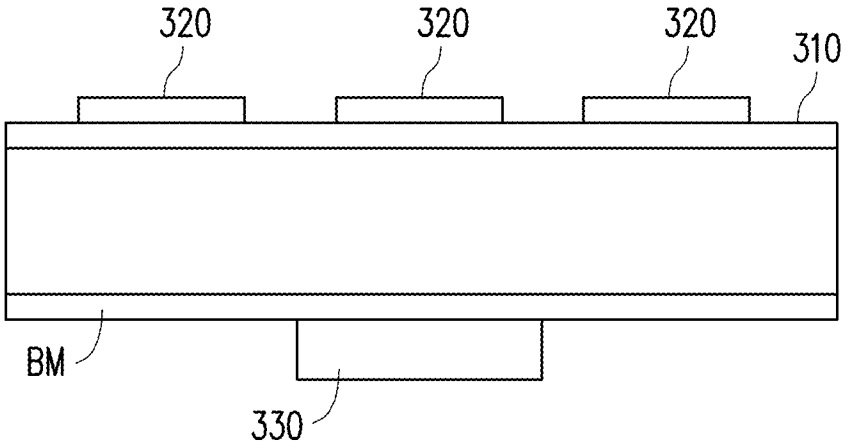

In FIG. 3D, the controller 330 may be embedded in the circuit board 310. In FIG. 3E, the controller 330 and the micro LED devices 320 may be disposed on different surfaces of the circuit board 310, and a light absorption layer BM is disposed between the circuit board 310 and the controller 330. The light absorption layer BM is configured to prevent the controller 330 from being affected by the light emitted by the micro LED devices 320. The light absorption layer BM is, for example, a black photoresist and may be configured to absorb light or block light. Alternatively, the controller 330 and the micro LED devices 320 may be disposed on the same surface of the circuit board 310, and a light absorption layer BM may be disposed between the circuit board 310 and the controller 330.

Figure 3F:
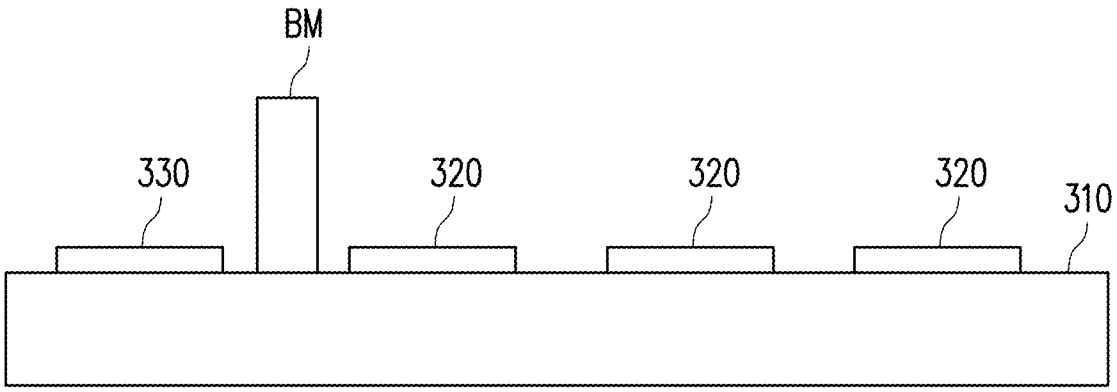

In FIG. 3F, the controller 330 and the micro LED devices 320 are disposed on the same surface of the circuit board 310. A light absorption layer BM may be disposed between the controller 330 and the micro LED devices 320. The light absorption layer BM is configured to prevent the controller 330 from being affected by the light emitted by the micro LED devices 320.

Figure 4:
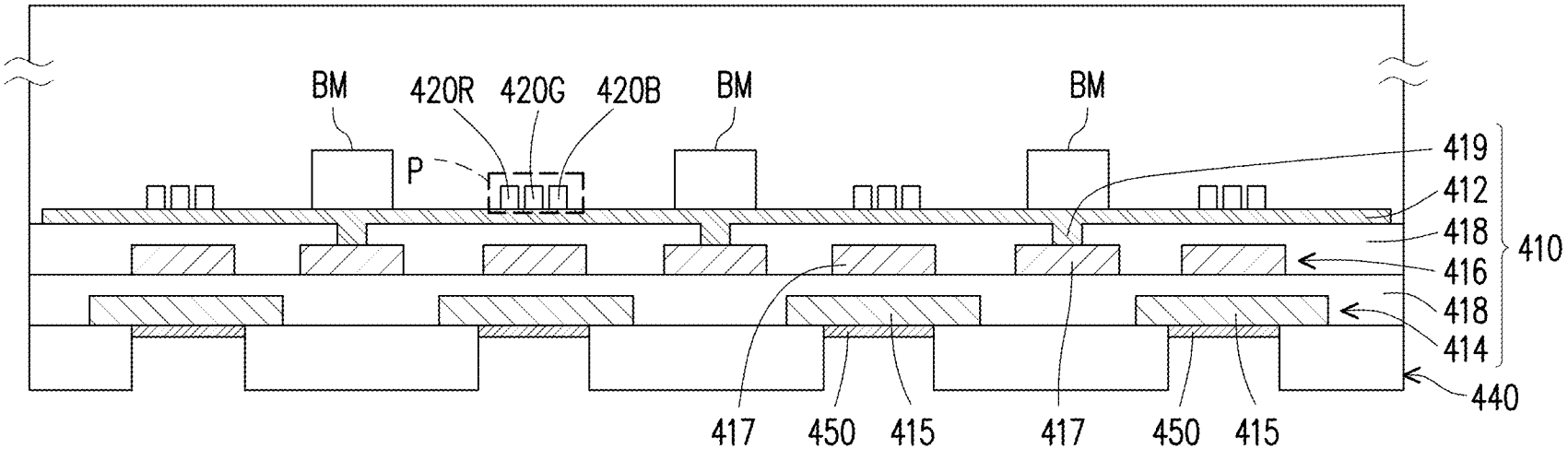
FIG. 4 is a schematic view showing a wiring layer in a micro LED device according to an embodiment of the disclosure.

The wiring layer 230 in the embodiment of FIG. 2B may also be designed with a multi-layer circuit structure. Referring to FIG. 4, FIG. 4 is a schematic view showing a wiring layer in a micro LED device according to an embodiment of the disclosure. In FIG. 4, the wiring layer of a micro LED device 400 is designed with a structure of a multi-layer circuit layer 410. The multi-layer circuit layer 410 includes a plurality of vias 419, and a top circuit layer 412, an internal circuit layer 416, and a bottom circuit layer 414 are electrically connected via the vias 419. In other words, the top circuit layer 412 and the internal circuit layer 416 are electrically connected via the vias 419, and the internal circuit layer 416 and the bottom circuit layer 414 are also electrically connected via the vias 419. FIG. 4 shows one cross section which only shows that the top circuit layer 412 and the internal circuit layer 416 are electrically connected via the vias 419. In another cross section not shown, the internal circuit layer 416 and the bottom circuit layer 414 are also electrically connected via the vias 419. In particular, it is possible that orthographic projections of the vias 419 on the bottom circuit layer 414 do not overlap with orthographic projections of micro LEDs 420R, 420G, and 420B on the bottom circuit layer 414. In other words, in the top view, the positions of the micro LEDs 420R, 420G, and 420B do not overlap with the positions of the vias 419. Furthermore, the internal circuit layer 416 of this embodiment includes a plurality of circuit patterns 417, and an orthographic projection of each light emitting pixel P (composed of the micro LEDs 420R, 420G, and 420B) on the bottom circuit layer 414 fully overlaps within the corresponding circuit pattern 417. Herein, an orthographic projection of each of the micro LEDs 420R, 420G, and 420B on the bottom circuit layer 414 fully overlaps within the corresponding circuit pattern 417. The micro LEDs 420R, 420G, and 420B may respectively emit beams of different wavelengths.

In addition, the micro LED device 400 of this embodiment further includes a surface treatment layer 450, and the surface treatment layer 450 is disposed on part of a top surface of a pad 415 exposed by an insulating layer 440. Exemplarily, the material of the surface treatment layer 450 is, for example, electroless nickel and immersion gold (ENIG), and the surface treatment layer 450 may effectively prevent or reduce oxidation of the pad 415 exposed by the insulating layer 440.

In FIG. 4, a light absorption layer BM may be provided between the pixels P to prevent the lights emitted by the pixels P from affecting each other.

Figure 5A:
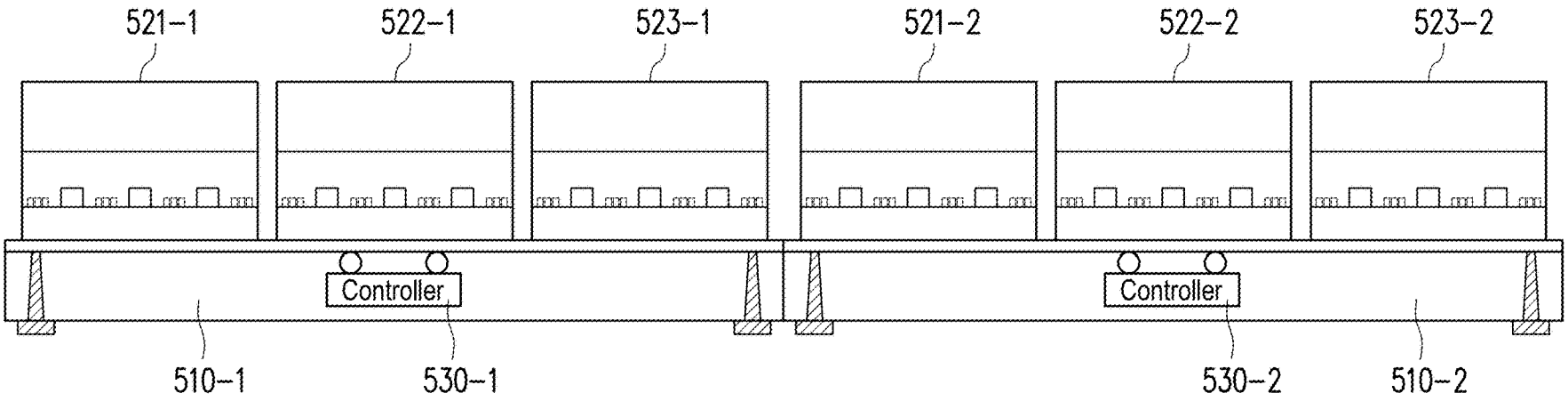
FIG. 5A is a schematic view showing a tiled micro LED display according to an embodiment of the disclosure.

Next, referring to FIG. 5A, FIG. 5A is a schematic view showing a tiled micro LED display according to an embodiment of the disclosure. A micro LED display 500 includes a plurality of circuit boards 510-1 and 510-2. The circuit boards 510-1 and 510-2 respectively carry a plurality of controllers 530-1 and 530-2 and a plurality of groups of micro LED devices 521-1 to 523-1 and 521-2 to 523-2.

In this embodiment, the controller 530-1 is configured to control the display statuses of the micro LED devices 521-1 to 523-1, and the controller 530-2 is configured to control the display statuses of the micro LED devices 521-2 to 523-2. Accordingly, the layout pitch of the micro LED devices 521-1 to 523-1 (or the micro LED devices 521-2 to 523-2) disposed on the same circuit board 510-1 (or the circuit board 510-2) can be effectively reduced to improve the resolution of the display image.

The number of the circuit boards 510-1 and 510-2 in this embodiment is not limited to two and may be more. The circuit boards 510-1 and 510-2 may be arranged in a regular array, or may also be arranged irregularly, and the disclosure is not limited thereto.

In addition, in this embodiment, the resolution that can be presented by the micro LED devices 521-1 to 523-1 carried on the circuit board 510-1 and the resolution that can be presented by the micro LED devices 521-2 to 523-2 carried on the circuit board 510-2 may be the same or different, and the disclosure is not limited thereto. According to the requirements of use, the designer may set the resolutions of the micro LED devices 521-1 to 523-1 and 521-2 to 523-2 to set the resolution of any region in the micro LED display 500.

Figure 5B:
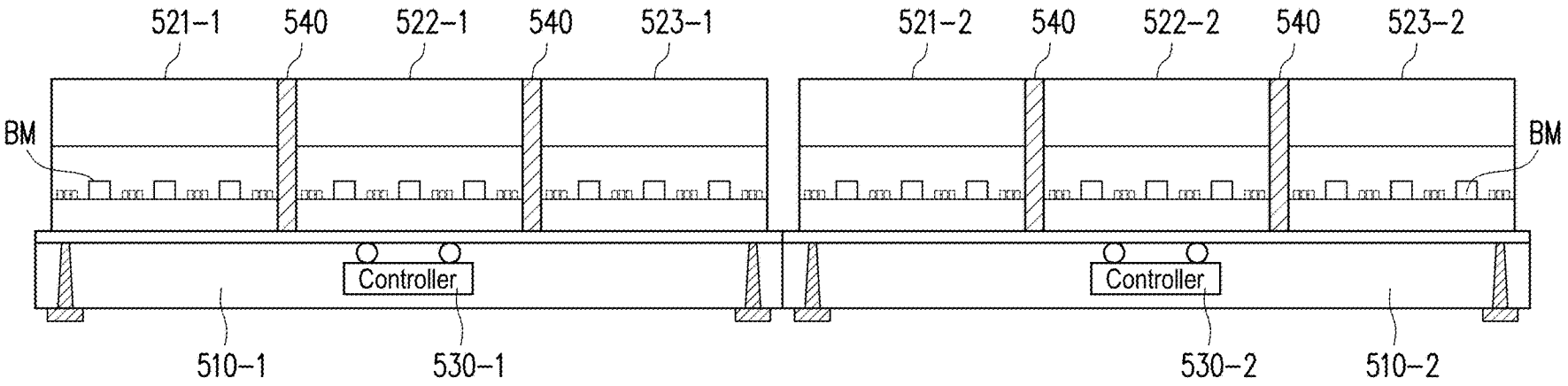
FIG. 5B is a schematic view showing a tiled micro LED display according to another embodiment of the disclosure.

Next, referring to FIG. 5B, FIG. 5B is a schematic view showing a tiled micro LED display according to another embodiment of the disclosure. Different from the embodiment in FIG. 5A, a light shielding structure 540 may be disposed between any adjacent two of the micro LED devices 521-1 to 523-1. The light shielding structure 540 may similarly be disposed between any adjacent two of the micro LED devices 521-2 to 523-2. The light shielding structure 540 is configured to prevent lights of the micro LED devices 521-1 to 523-1 and lights of the micro LED devices 521-2 to 523-2 from affecting each other and can improve the display quality. Another light shielding structure (not shown) may also be disposed between any two of the micro LED devices 521-2 to 523-2 to prevent lights of the micro LED displays from affecting each other.

Figure 6:
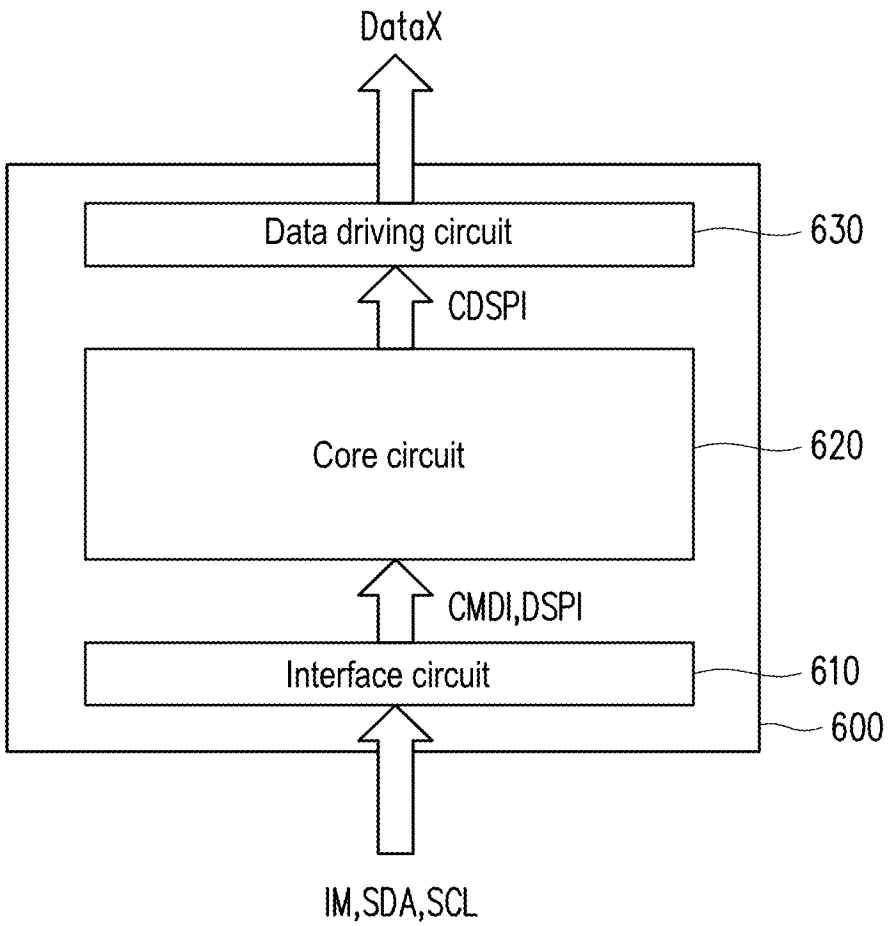
FIG. 6 is a schematic view showing a controller in a micro LED display according to an embodiment of the disclosure.

Next, referring to FIG. 6, FIG. 6 is a schematic view showing a controller in a micro LED display according to an embodiment of the disclosure. A controller 600 includes an interface circuit 610, a core circuit 620, and a data driving circuit 630. Based on a mode setting signal IM, the interface circuit 610 receives a command/data signal SDA according to a clock signal SCL to obtain a command data and a display data. The interface circuit 610 may include a serial peripheral interface (SPI) and receive the command/data signal SDA, which is a serial signal, according to the clock signal SCL to obtain a command data CMDI and a display data DSPI.

The core circuit 620 is coupled to the interface circuit 610 to receive the command data CMDI and the display data DSPI. According to the arrangement of a plurality of micro LEDs of the pixel array in each micro LED device in the micro LED display, the core circuit 620 performs a pixel arrangement calculation on the display data DSPI to generate a compensated display data CDSPI. The arrangement of the micro LEDs of the pixel array in each micro LED device may be recorded in a memory in advance. The core circuit 620 may access the memory to obtain the arrangement of the micro LEDs of the pixel array in each micro LED device and perform the pixel arrangement calculation accordingly to obtain the compensated display data CDSPI.

The data driving circuit 630 is coupled to the core circuit 620. The data driving circuit 630 receives the compensated display data CDSPI and generates a control signal DataX according to the compensated display data CDSPI to control the display status of each micro LED device.

In addition, the core circuit 620 may also adjust the display data DSPI according to a de-mura data to generate a de-mura display data. A mura data of the micro LED display may be detected in advance. A de-mura data may be obtained based on the detected mura data and stored in the memory in advance. The core circuit 620 may obtain the de-mura data by accessing the memory and may adjust the display data DSPI accordingly. In this embodiment, the core circuit 620 may perform a de-mura operation of the display data DSPI by looking up a mapping table and performing interpolation.

On the other hand, the core circuit 620 may also operate in an always-on-display (AOD) mode. In the always-on-display mode, the core circuit 620 may suspend the interface circuit 610 from receiving the display data DSPI from the outside, have the memory provide the display data DSPI to serve as the basis for generating the control signal DataX, and start a charge pump circuit to generate a boost power. At this time, the controller 600 may provide the boost power to the micro LED device to serve as an operating power for the micro LED device. The micro LED device may perform display of an image based on this operating power according to the control signal DataX.

In the always-on-display mode, the display data DSPI is no longer received from the outside, which can thus save the power consumed by the interface circuit 610. In addition, the micro LED device no longer receives the power supplied by the outside as the operating power, but instead uses the boost power generated by the internal charge pump circuit as the operating power, which can also save power consumption.

In the always-on-display mode, the display data DSPI provided by the memory may be a static display picture of one single image, or a dynamic picture of a plurality of images, and the disclosure is not limited thereto.

In terms of hardware architecture, the core circuit 620 may be constructed by a digital circuit. Those with ordinary skill in the art may apply various conventional digital circuit design methods to realize the core circuit 620, and the disclosure is not limited thereto.

On the other hand, the controller 600 may be further provided with a temperature sensor (not shown). The temperature sensor may be configured to detect an ambient temperature. The controller 600 may adjust the generated control signal DataX according to changes in the ambient temperature to further optimize the display quality.

In this embodiment, the data driving circuit 630 may be a plurality of multiplexing circuits. The multiplexing circuits may be configured to transmit the compensated display data CDSPI in a time-dividing manner to generate the control signal DataX and control the display status of a plurality of micro LED devices.

Figure 7:
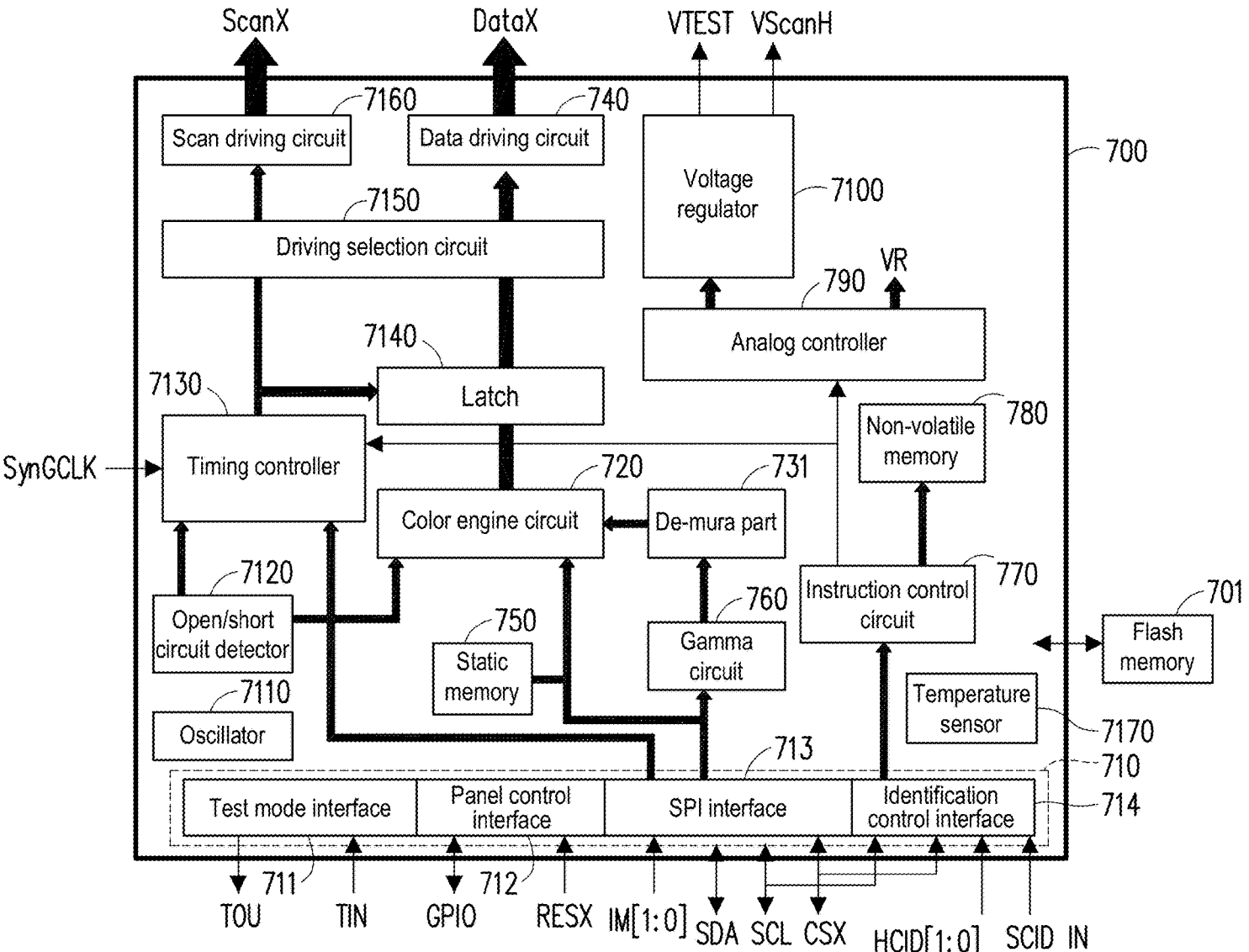
FIG. 7 is a schematic view showing a controller in a micro LED display according to another embodiment of the disclosure.

Referring to FIG. 7, FIG. 7 is a schematic view showing a controller in a micro LED display according to another embodiment of the disclosure. A controller 700 includes an interface circuit 710, a color engine circuit 720, a de-mura part 731, a data driving circuit 740, a static memory 750, a gamma circuit 760, an instruction control circuit 770, a non-volatile memory 780, an analog controller 790, a voltage regulator 7100, an oscillator 7110, an open/short circuit detector 7120, a timing controller 7130, a latch 7140, a driving selection circuit 7150, a scan driving circuit 7160, and a temperature sensor 7170. The interface circuit 710 has a test mode interface 711, a panel control interface 712, an SPI interface 713, and an identification control interface 714. The test mode interface 711 transmits and receives a test input signal TIN and a test output signal TOU. The panel control interface 712 transmits and receives a general-purpose input/output signal GPIO and receives a reset signal RESX. The SPI interface 713 receives a clock signal SCL and receives a command/data signal SDA according to the clock signal SCL. The SPI interface may be activated according to a chip selection signal CSX. The identification control interface 714 receives identification and authentication signals SCID_IN and HCID[1:0].

The SPI interface 713 may obtain a command data and a display data according to the command/data signal SDA. The display data may be transmitted to the color engine circuit 720, the gamma circuit 760, and the static memory 750. The command data may be transmitted to the color engine circuit 720. The gamma circuit 760 may perform gamma conversion on the display data. The de-mura part 731 is coupled to the color engine circuit 720 and the gamma circuit 760. The de-mura part 731 performs a de-mura operation on the gamma converted display data, and transmits the display data after the de-mura operation to the color engine circuit 720. The color engine circuit 720 may perform a pixel arrangement calculation on the display data after the de-mura operation to generate a compensated display data, and transmit the compensated display data to the latch 7140. In this embodiment, the de-mura part 731 and the color engine circuit 720 may be provided in the core circuit.

On the other hand, the timing controller 7130 receives a synchronization signal SynGCLK, and generates a timing signal for controlling a display operation according to the synchronization signal SynGCLK. According to the timing signal generated by the timing controller 7130, the latch 7140 provides the compensated display data to the driving selection circuit 7140. According to the timing signal generated by the timing controller 7130, the driving selection circuit 7140 provides a control signal to the scan driving circuit 7160 and the data driving circuit 740.

The scan driving circuit 7160 is configured to generate a scan signal ScanX for performing a scan operation on each display row of the pixel array of the micro LED device, and the data driving circuit 740 generates a control signal DataX corresponding to the scan signal ScanX. In this embodiment, the control signal DataX is a display intensity of the pixels corresponding to the scan signal ScanX.

In terms of the voltage generation mechanism, the analog controller 790 is coupled to the instruction control circuit 770. The analog controller 790 controls the voltage regulator 7100 to generate a test voltage VTEST and a scan voltage VScanH. The analog controller 790 may further generate a reference voltage VR.

In this embodiment, the static memory 750 and the non-volatile memory 780 may be configured to store any data required for the operations performed by the controller 700. The controller 700 may be coupled to an external flash memory 701 to perform a read operation of any data.

In addition, the oscillator 7110 is configured to generate a clock signal, and the clock signal serves as a reference for the controller 700 to perform operations. The open/short circuit detector 7120 is configured to detect whether pins of the controller 700 are open or shorted to start a protective operation accordingly. The temperature sensor 7170 is configured to sense an ambient temperature and provide relevant data to any internal circuit in the controller 700.

The controller 700 may be constructed in the form of a single die, or may be implemented as one integrated circuit in the form of a system in package (SIP).

Figure 8:
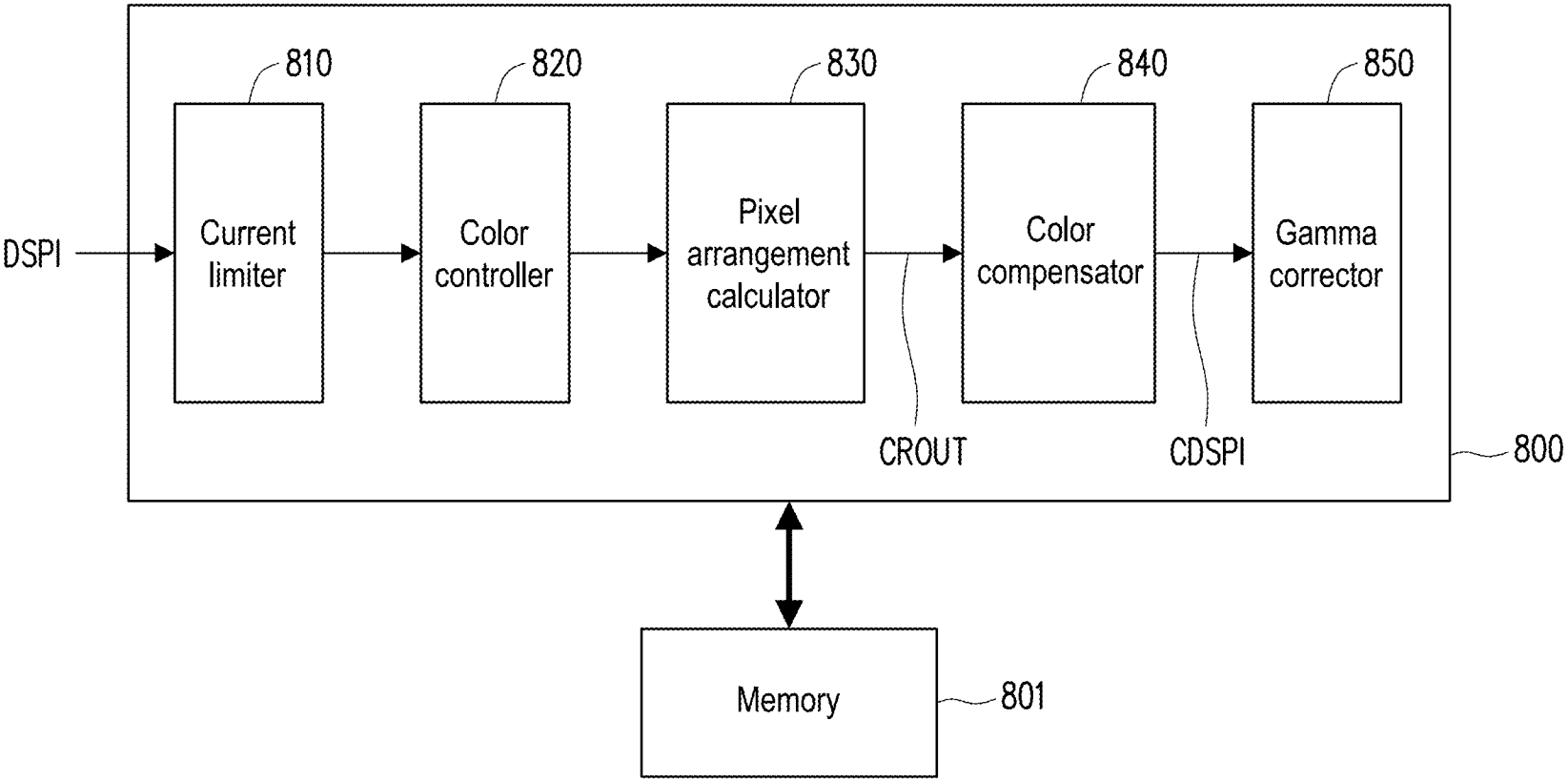
FIG. 8 is a schematic view showing a color engine circuit of a controller in a micro LED display according to an embodiment of the disclosure.

Next, referring to FIG. 8, FIG. 8 is a schematic view showing a color engine circuit of a controller in a micro LED display according to an embodiment of the disclosure. A color engine circuit 800 includes a current limiter 810, a color controller 820, a pixel arrangement calculator 830, a color compensator 840, and a gamma corrector 850. The current limiter 810 receives a display data DSPI and, according to an algorithm, limits the output current based on an update frequency of the display data DSPI to achieve power saving effect. The color controller 820 is coupled to the current limiter 810 to adjust the display data DSPI according to a set color mode. The set color mode may include a normal mode, an enhance mode, or a standard color gamut mode. The pixel arrangement calculator 830 is coupled to the color controller 820 and performs a pixel arrangement calculation on the display data according to the arrangement data of the micro LEDs to generate a calculation result CROUT. The arrangement data of the micro LEDs may be stored in a memory 801 in advance. The memory 801 is coupled to the color engine circuit 800 for the color engine circuit 800 to read.

The color compensator 840 is coupled to the pixel arrangement calculator 830. According to the calculation result CROUT generated by the pixel arrangement calculator 830, the color compensator 820 compensates the display data DSPI to generate a compensated display data CDSPI and adjusts the display data DSPI in correspondence with the arrangement of the micro LEDs of each pixel, so as to improve the presentation of the generated display image. The gamma corrector 850 is coupled to the color compensator 840 and is configured to perform gamma correction on the compensated display data CDSPI.

Figure 9A:
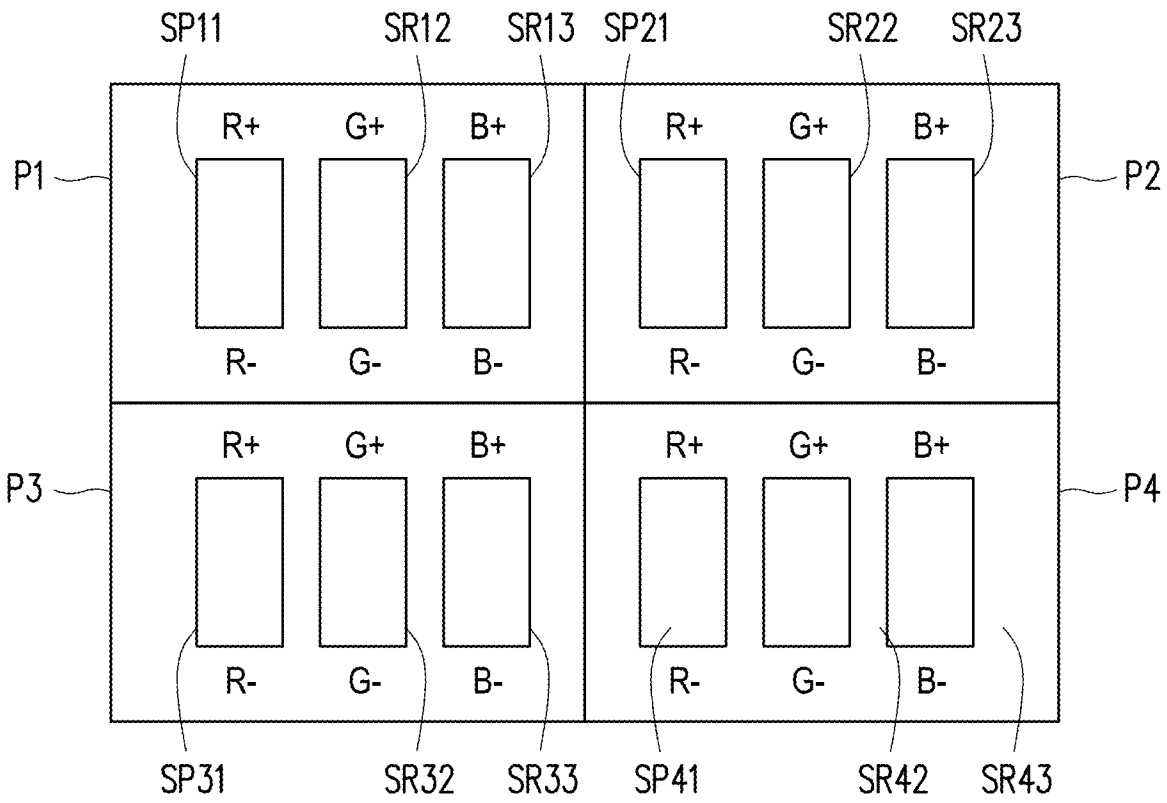
FIG. 9A to FIG. 9D are schematic views showing arrangements of micro LEDs in one pixel array in a micro LED display according to embodiments of the disclosure.

Herein, the arrangement of the micro LEDs may come in many different configurations. Referring to FIG. 9A to FIG. 9D, FIG. 9A to FIG. 9D are schematic views showing arrangements of micro LEDs in one pixel array in a micro LED display according to a plurality of embodiments of the disclosure. In FIG. 9A, pixels P1 to P4 may be arranged in an array. The pixels P1 to P4 respectively include sub-pixels SP11 to SP13, sub-pixels SP21 to SP23, sub-pixels SP31 to SP33, and sub-pixels SP41 to SP43. First terminals of the sub-pixels SP11, SP21, SP31, and SP41 may receive a positive driving voltage R+. Second terminals of the sub-pixels SP11, SP21, SP31, and SP41 may receive a negative driving voltage R−. First terminals of the sub-pixels SP12, SP22, SP32, and SP42 may receive a positive driving voltage G+. Second terminals of the sub-pixels SP12, SP22, SP32, and SP42 may receive a negative driving voltage G−. First terminals of the sub-pixels SP13, SP23, SP33, and SP43 may receive a positive driving voltage B+. Second terminals of the sub-pixels SP13, SP23, SP33, and SP43 may receive a negative driving voltage B−.

In this embodiment, taking the pixel P1 as an example, and the sub-pixels SP11 to SP13 may be orderly and sequentially arranged in the pixel P1.

Figure 9B:
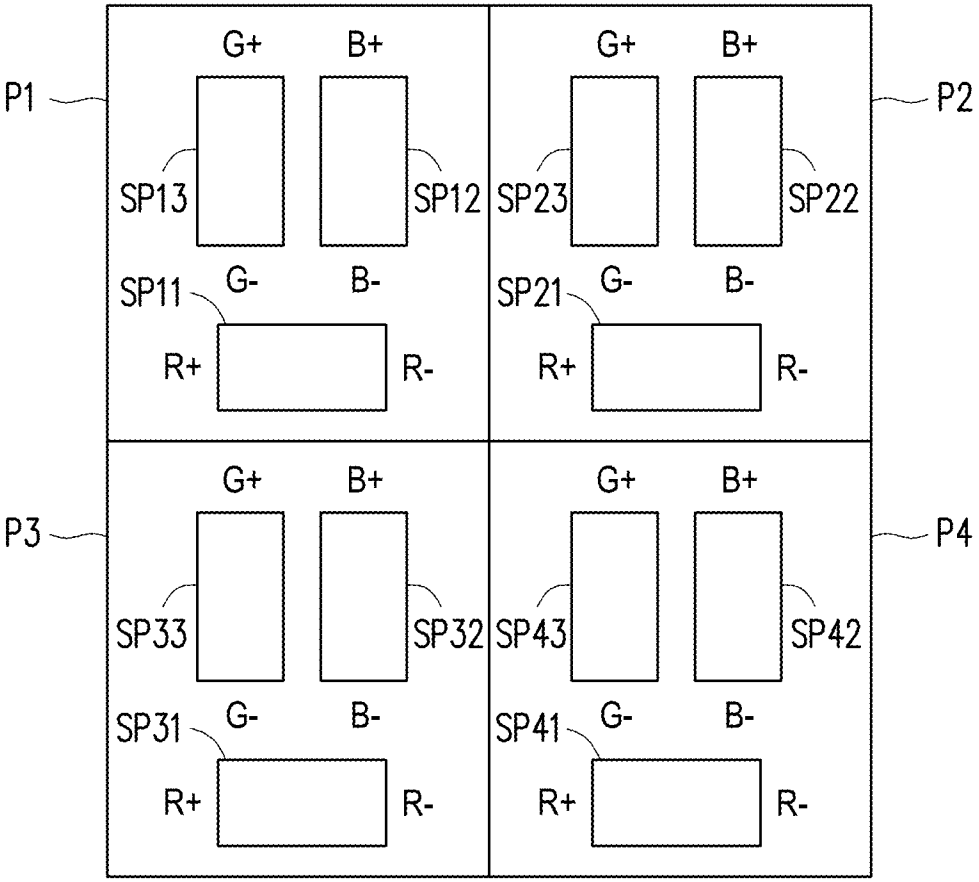

In FIG. 9B, pixels P1 to P4 may also be arranged in an array. Compared to the embodiment in FIG. 9A, in FIG. 9B, taking the pixel P1 as an example, a plurality of sub-pixels SP13 and SP12 in the pixel P1 may be arranged on a first side of the pixel P1 according to a same first orientation (vertical direction), and the sub-pixel SP11 may be arranged on a second side of the pixel P1 according to a second orientation (horizontal direction).

Figure 9C:
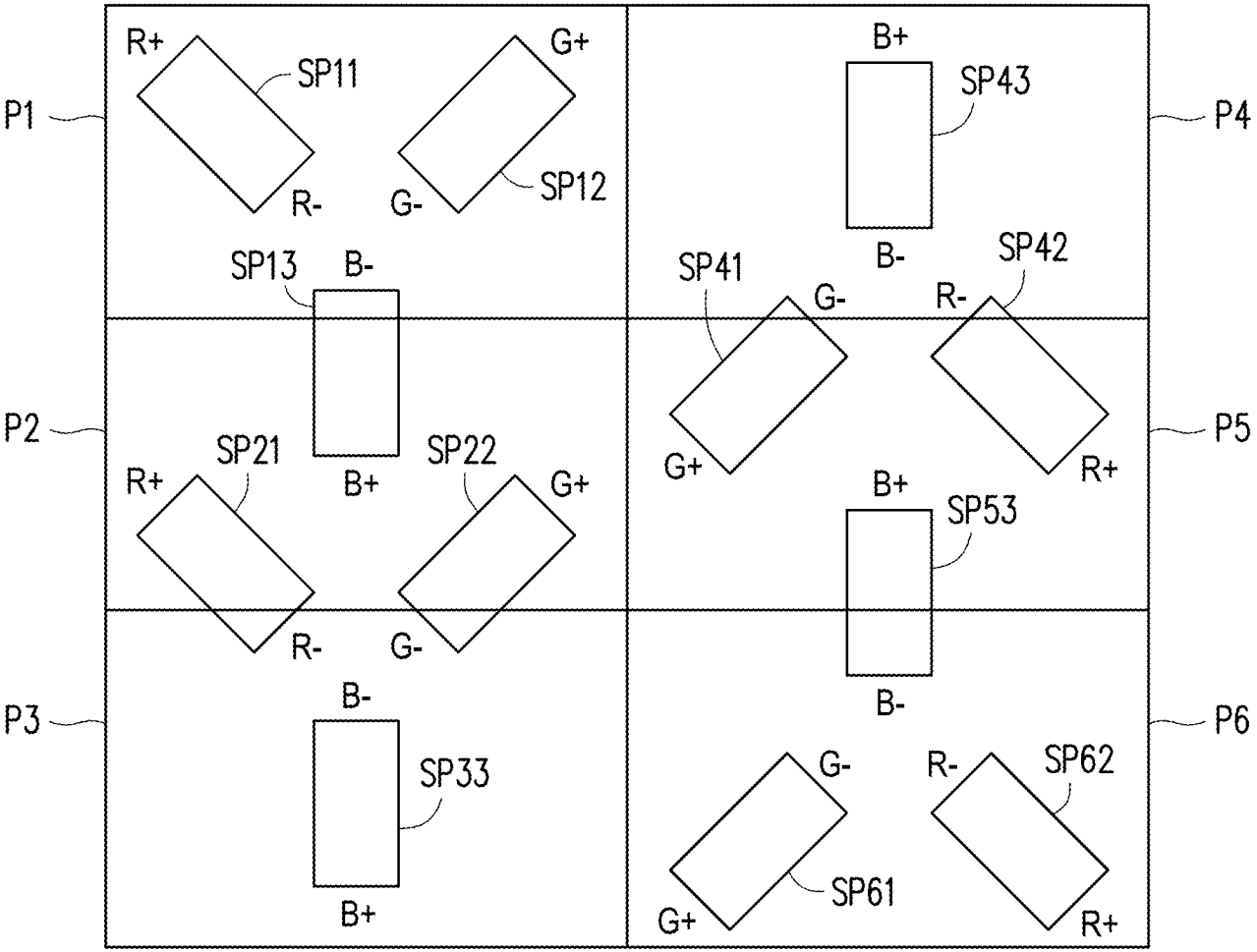

In FIG. 9C, pixels P1 to P6 may be arranged in an array. Different from the above embodiments, each of pixels P1 to P6 in this embodiment does not independently have three sub-pixels. The pixel P1 has sub-pixels SP11 to SP13, and shares the sub-pixel SP13 with the pixel P2. The pixel P2 includes part of the sub-pixel SP13 and sub-pixels SP21 and SP22, and shares the sub-pixels SP21 and SP22 with the pixel P3. The pixel P3 includes part of the sub-pixels SP21 and SP22 and a sub-pixel SP33. In another display column, the pixel P4 has sub-pixels SP41 to SP43, and shares the sub-pixels SP41 and SP42 with the pixel P5. The pixel P5 includes a sub-pixel SP53 and part of the sub-pixels SP41 and SP42, and shares the sub-pixel SP53 with the pixel P6. The pixel P6 includes part of the sub-pixel SP53 and sub-pixels SP61 and SP62.

In this embodiment, a plurality of sub-pixels (e.g. the sub-pixels SP11 to SP13) of one pixel (e.g., the pixel P1) may be disposed according to three different orientations, and the orientations of any two of the sub-pixels SP11 to SP13 may differ by 120 degrees.

In addition, among the shared sub-pixels (e.g., the sub-pixel SP13), the size of the sub-pixel SP13 configured in the pixels P1 and P2 may be adjusted by the designer according to the actual requirements, and the disclosure is not limited thereto.

Figure 9D:
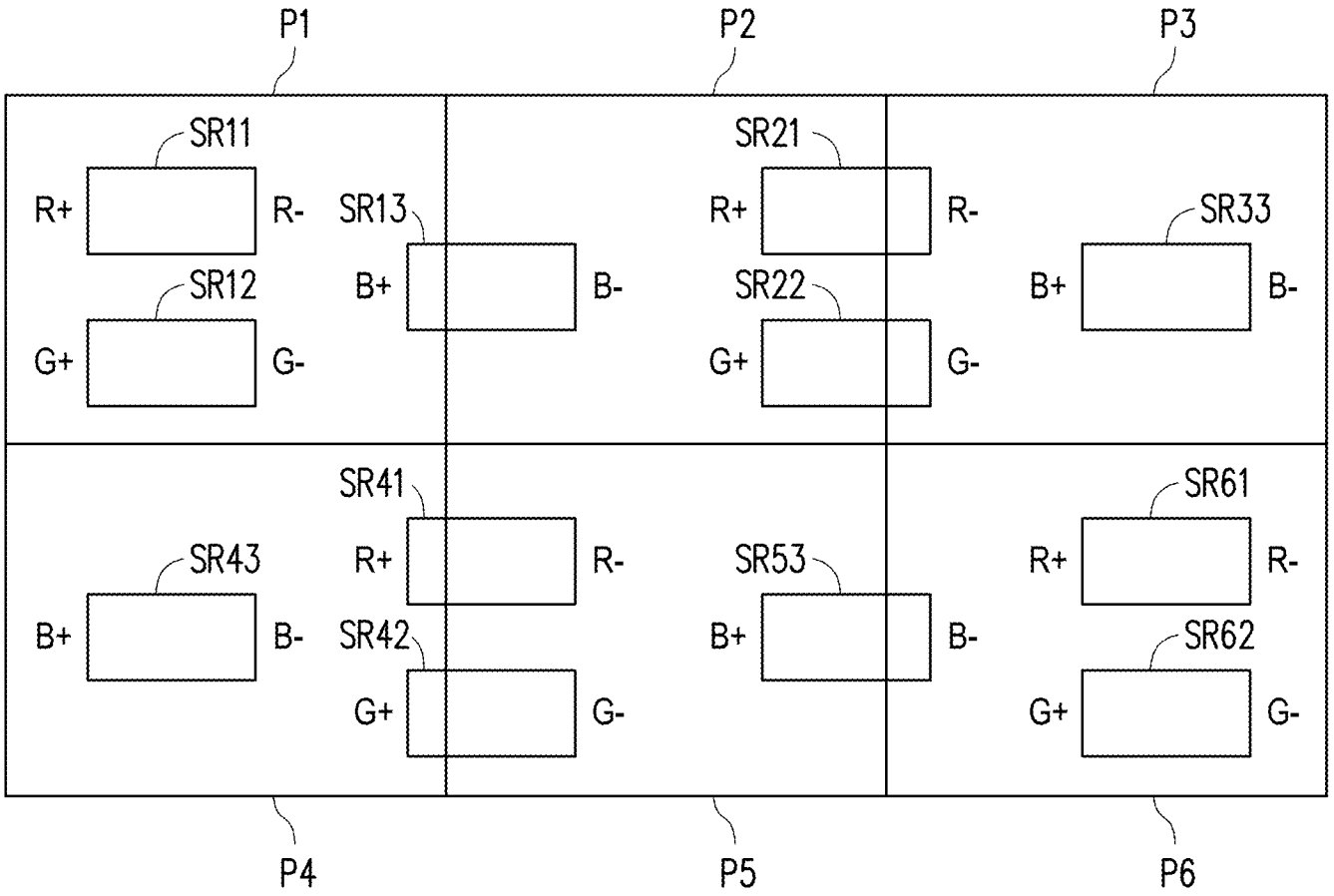

In FIG. 9D, pixels P1 to P6 may be arranged in an array. The distribution of sub-pixels SP11 to SP62 in the pixels P1 to P6 may be the same as in the embodiment of FIG. 9C. Different from the above embodiment, the orientations of the sub-pixels SP11 to SP62 in this embodiment may all be the second orientation (horizontal direction). Of course, in other embodiments of the disclosure, the orientations of the sub-pixels SP11 to SP62 may all be the first orientation (vertical direction).

It is noted that the a plurality of configurations of the pixels and the sub-pixels shown in FIG. 9A to FIG. 9D are only examples for illustration and do not limit the scope of the disclosure. Those with ordinary skill in the art may apply herein any configuration obtained by combining two or more embodiments described above.

Figure 10:
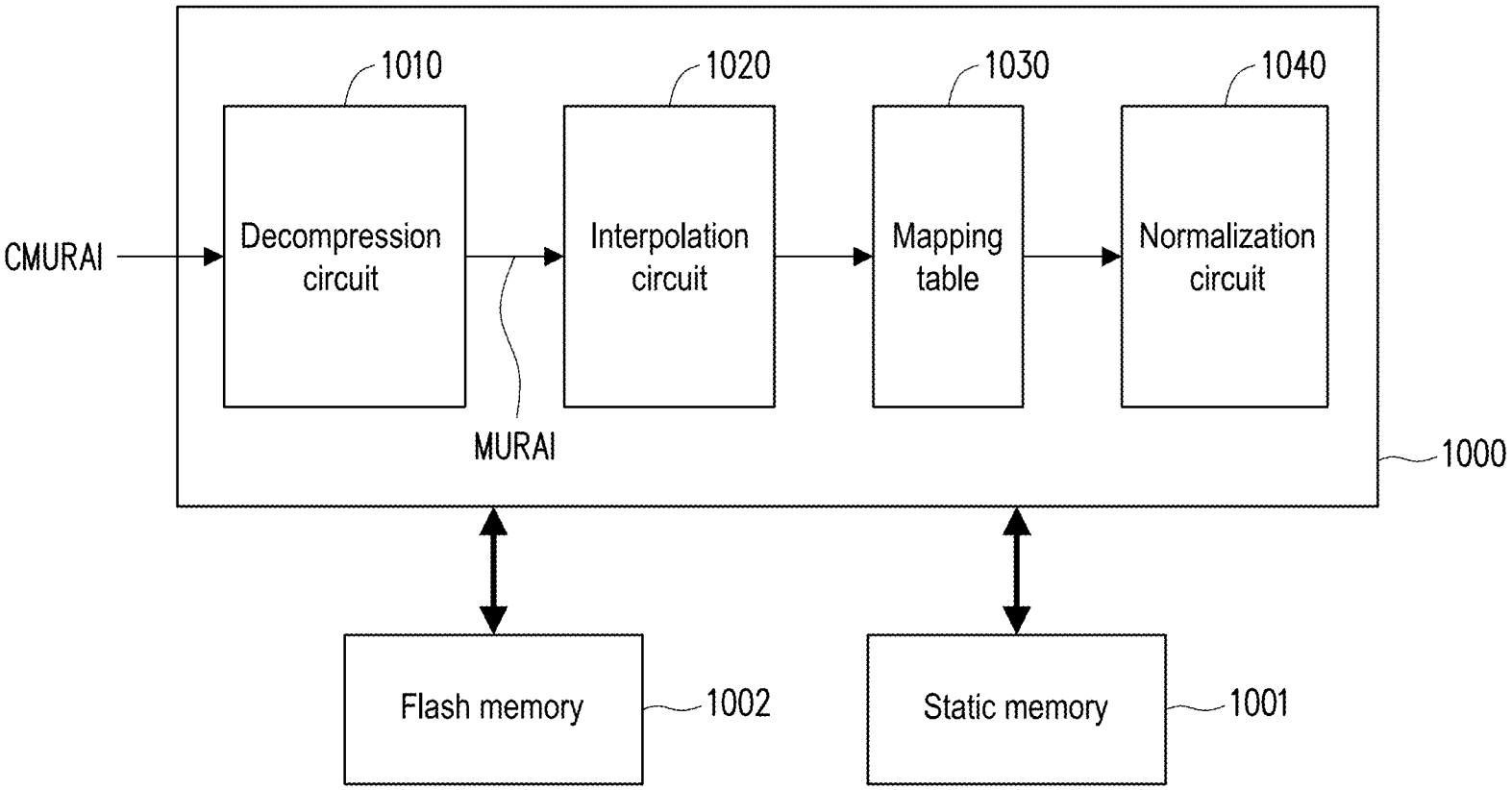
FIG. 10 is a schematic view of a de-mura part of a controller in a micro LED display according to an embodiment of the disclosure.

Next, referring to FIG. 10, FIG. 10 is a schematic view of a de-mura part of a controller in a micro LED display according to an embodiment of the disclosure. A de-mura part 1000 includes a decompression circuit 1010, an interpolation circuit 1020, a mapping table 1030, and a normalization circuit 1040. The de-mura part 1000 may be coupled to a flash memory 1002 and a static memory 1001. The decompression circuit 1010 may perform decompression on a compressed de-mura data CMURAI to obtain a de-mura data MURAI. To save storage space, the de-mura data MURAI may be stored in the flash memory 1002 in a compressed form in advance. When a de-mura operation is to be performed, the de-mura part 1000 may first read the compressed de-mura data CMURAI in the flash memory 1002, and then obtain the de-mura data MURAI through decompression performed by the decompression circuit 1010.

Then, according to a de-mura algorithm, the interpolation circuit 1020 may perform interpolation on the de-mura data MURAI to generate a plurality of compensation difference values respectively corresponding to a plurality of pixels. The de-mura part 1000 obtains a compensated display data based on the mapping table 1030 according to the compensation difference value. To limit the magnitude of the value of the compensated display data, the de-mura part 1000 may normalize the compensated display data by the normalization circuit 1040 and output the normalized result.

Figure 11:
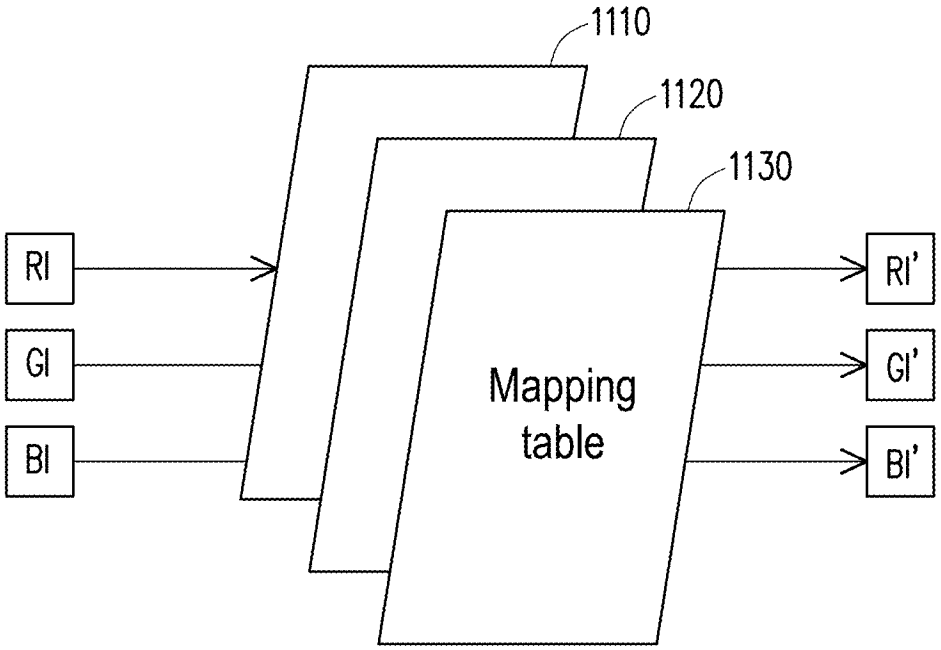
FIG. 11 is a schematic view showing a mapping table in a de-mura part according to an embodiment of the disclosure.

In this embodiment, the mapping table 1030 may map the display data corresponding to three different wavelengths in the display data. Referring to FIG. 11, FIG. 11 is a schematic view showing a mapping table in a de-mura part according to an embodiment of the disclosure. The mapping table may include three mapping tables 1110 to 1130 corresponding to red, green, and blue display pixels. The mapping tables 1110 to 1130 respectively receive display data RI, GI, and BI corresponding to different colors. Each of the display data RI, GI, and BI is an 8-bit data, for example. The mapping tables 1110 to 1130 respectively record de-mura data corresponding to pixels of different colors in different regions of the display panel in the micro LED display. Through mapping of the mapping tables 1110 to 1130, compensated display data RI', GI', and BI' may be respectively generated. Each of the compensated display data RI', GI', and BI' may be a 16-bit data.

Accordingly, the driving of the micro LEDs is performed based on the compensated display data RI', GI', and BI', so that the micro LEDs can have a 16-bit resolution.

In summary of the above, the micro LED display of the disclosure controls the display statuses of a plurality of micro LED devices through one controller. Accordingly, the layout pitch between the micro LED devices can be reduced, which can improve the resolution of the display image. The controller of the embodiment of the disclosure performs a pixel arrangement calculation on the display data according to the arrangement of the micro LEDs and generates the compensated display data accordingly. Therefore, it is possible to effectively improve the display quality of the display image.

What is claimed is:

1. A micro light emitting diode display comprising:

a first circuit board;

a plurality of first micro light emitting diode devices disposed on a first surface of the first circuit board, wherein the first micro light emitting diode devices respectively have a plurality of first pixel arrays; and a first controller carried by the first circuit board and configured to transmit a plurality of first control signals to respectively control display statuses of the first pixel arrays of the first micro light emitting diode devices, wherein each of the first micro light emitting diode devices comprises:

a wiring layer;

an optical adhesive layer disposed on the wiring layer;

a plurality of micro light emitting diodes disposed in the optical adhesive layer and forming a corresponding first pixel array, wherein the wiring layer is coupled between a plurality of transmission lines and the plurality of micro light emitting diodes; and a light mixing layer disposed on the optical adhesive layer.

2. The micro light emitting diode display according to claim 1, wherein orthographic projections of the first micro light emitting diode devices on the first circuit board do not overlap with an orthographic projection of the first controller on the first circuit board.

3. The micro light emitting diode display according to claim 1, wherein a number of each of the first pixel arrays in each of the first micro light emitting diode devices is greater than n times m, where n and m are integers greater than or equal to 4.

4. The micro light emitting diode display according to claim 1, wherein the first surface of the first circuit board is provided with the plurality of transmission lines, the plurality of transmission lines are disposed between the first surface of the first circuit board and the first micro light emitting diode devices, and the first controller is electrically connected to the first micro light emitting diode devices via the transmission lines.

5. The micro light emitting diode display according to claim 1, wherein the wiring layer is coupled to the transmission line via at least one conductive bump.

6. The micro light emitting diode display according to claim 1, wherein the first controller is embedded in the first circuit board and is electrically coupled to the wiring layer via a plurality of vias.

7. The micro light emitting diode display according to claim 1, wherein the first controller is disposed on a second surface of the first circuit board or the first surface, wherein the first surface is opposite to the second surface, and the first controller disposed on the second surface is electrically coupled to the wiring layer via a plurality of vias.

8. The micro light emitting diode display according to claim 1, further comprising:

a light absorption layer disposed between the first controller and the first micro light emitting diode devices.

9. The micro light emitting diode display according to claim 1, further comprising:

at least one second circuit board tiled with the first circuit board;

a plurality of second micro light emitting diode devices disposed on a first surface of the at least one second circuit board, wherein the second micro light emitting diode devices respectively have a plurality of second pixel arrays; and at least one second controller carried by the corresponding at least one second circuit board and configured to transmit a plurality of second control signals to respectively control display statuses of the second pixel arrays of the second micro light emitting diode devices.

10. The micro light emitting diode display according to claim 9, wherein a display resolution of the first pixel arrays is different from a display resolution of the second pixel arrays.

11. The micro light emitting diode display according to claim 1, wherein the first controller comprises:

an interface circuit receiving a command/data signal according to a clock signal based on a mode setting signal to obtain a command data and a display data;

a data driving circuit configured to generate the first control signals to respectively control the display statuses of the first pixel arrays; and a core circuit coupled to the interface circuit and the data driving circuit and configured to:

perform a pixel arrangement calculation on the display data according to an arrangement of a plurality of micro light emitting diodes of each of the first pixel arrays to generate a compensated display data, wherein the data driving circuit generates the first control signals according to the compensated display data.

12. The micro light emitting diode display according to claim 11, wherein the core circuit comprises:

a color engine circuit comprising:

a current limiter receiving the display data and configured to limit a transmission current of the display data to less than or equal to a predetermined threshold value;

a color controller coupled to the current limiter and adjusting the display data according to a set color mode;

a pixel arrangement calculator coupled to the color controller and performing the pixel arrangement calculation on the display data according to an arrangement data of the micro light emitting diodes to generate a calculation result;

a color compensator coupled to the pixel arrangement calculator and compensating the display data according to the calculation result to generate the compensated display data; and a gamma corrector coupled to the color compensator and performing a gamma correction on the compensated display data to generate an output display data.

13. The micro light emitting diode display according to claim 12, wherein the color engine circuit further comprises:

a memory configured to store the arrangement data of the micro light emitting diodes.

14. The micro light emitting diode display according to claim 11, wherein the core circuit is further configured to adjust the display data according to a de-mura data to generate a de-mura display data, wherein the core circuit further comprises:

a de-mura part comprising:

a decompression circuit performing a decompression on a compressed de-mura data to obtain the de-mura data;

an interpolation circuit performing an interpolation on the de-mura data according to a de-mura algorithm to generate a plurality of compensation difference values respectively corresponding to a plurality of pixels; and a mapping table coupled to the interpolation circuit and obtaining the compensated display data according to the compensation difference values.

15. The micro light emitting diode display according to claim 14, wherein the de-mura part further comprises a normalization circuit configured to normalize the compensated display data.

16. The micro light emitting diode display according to claim 14, wherein the de-mura part further comprises:

a non-volatile memory configured to store the compressed de-mura data; and a static memory configured to store a temporary storage data.

17. The micro light emitting diode display according to claim 11, wherein in an always-on-display mode, the core circuit is further configured to:

suspend the interface circuit from receiving the display data, have a memory provide the display data to serve as a basis for generating the first control signals, and start a charge pump circuit to generate a boost power, wherein in the always-on-display mode, the first controller provides the boost power to the first micro light emitting diode devices to serve as an operating power of the first micro light emitting diode devices.

18. The micro light emitting diode display according to claim 11, wherein the core circuit further comprises:

a temperature sensor configured to sense an ambient temperature.

19. The micro light emitting diode display according to claim 11, wherein the data driving circuit comprises a plurality of multiplexing circuits configured to transmit the compensated display data to the first micro light emitting diode devices.

20. A controller configured to drive a micro light emitting diode display, the controller comprising:

an interface circuit receiving a command/data signal according to a clock signal based on a mode setting signal to obtain a command data and a display data;

a data driving circuit configured to generate a plurality of control signals to respectively control display statuses of a plurality of pixel arrays; and a core circuit coupled to the interface circuit and the data driving circuit and configured to:

perform a pixel arrangement calculation on the display data according to an arrangement of a plurality of micro light emitting diodes of each of the pixel arrays to generate a compensated display data, wherein the data driving circuit generates the control signals according to the compensated display data to respectively drive a plurality of micro light emitting diode devices.

21. The controller according to claim 20, wherein the core circuit comprises:

a color engine circuit comprising:

a current limiter receiving the display data and configured to limit a transmission current of the display data to less than or equal to a predetermined threshold value;

a color controller coupled to the current limiter and adjusting the display data according to a set color mode;

a pixel arrangement calculator coupled to the color controller and performing the pixel arrangement calculation on the display data according to an arrangement data of the micro light emitting diodes to generate a calculation result;

a color compensator coupled to the pixel arrangement calculator and compensating the display data according to the calculation result to generate the compensated display data; and a gamma corrector coupled to the color compensator and performing a gamma correction on the compensated display data to generate an output display data.

22. The controller according to claim 21, wherein the color engine circuit further comprises:

a memory configured to store the arrangement data of the micro light emitting diodes.

23. The controller according to claim 21, wherein in an always-on-display mode, the core circuit is further configured to:

suspend the interface circuit from receiving the display data, have a memory provide the display data to serve as a basis for generating the control signals, and start a charge pump circuit to generate a boost power, wherein in the always-on-display mode, the controller provides the boost power to the micro light emitting diode devices to serve as an operating power of the micro light emitting diode devices.

24. The controller according to claim 20, wherein the core circuit is further configured to adjust the display data according to a de-mura data to generate a de-mura display data, wherein the core circuit further comprises:

a de-mura part comprising:

a decompression circuit performing a decompression on a compressed de-mura data to obtain the de-mura data;

an interpolation circuit performing an interpolation on the de-mura data according to a de-mura algorithm to generate a plurality of compensation difference values respectively corresponding to a plurality of pixels; and a mapping table coupled to the interpolation circuit and obtaining the compensated display data according to the compensation difference values.

* * * * *